United States Patent [19]

Russell

[11] 4,434,734

[45] Mar. 6, 1984

[54] ANTI-SPILL DEVICE FOR SEWING MACHINE BOBBIN

[75] Inventor: Angus R. T. Russell, Englishtown, N.J.

[73] Assignee: The Singer Company, Stamford, Conn.

[21] Appl. No.: 235,467

[22] Filed: Feb. 18, 1981

[51] Int. Cl.[3] ..... D05B 57/26

[52] U.S. Cl. ..... 112/181; 112/229; 112/231

[58] Field of Search ..... 112/181, 229, 230, 231, 112/233

[56] References Cited

U.S. PATENT DOCUMENTS

| | | | |
|---|---|---|---|
| 296,790 | 4/1884 | Smith | 112/232 |
| 1,386,146 | 8/1921 | Weaver | 112/233 |
| 2,379,882 | 7/1945 | Clark | 112/231 X |
| 2,555,658 | 6/1951 | Ritter | 112/229 |
| 2,975,738 | 3/1961 | Hoppe | 112/233 |
| 3,486,473 | 12/1969 | Ross | 112/229 |
| 3,545,390 | 12/1970 | Kucera | 112/233 X |
| 3,940,089 | 2/1976 | Lindquist | 112/229 X |
| 4,157,691 | 6/1979 | Cerliani | 112/229 |

*Primary Examiner*—Wm. Carter Reynolds

*Attorney, Agent, or Firm*—Edward P. Schmidt; Robert E. Smith; Edward L. Bell

[57] ABSTRACT

A non-spill bobbin case device having a bobbin thread tension spring and a direct bobbin thread path extending from the bobbin thread tension spring across the bobbin case device spaced from the outer face of a bobbin flange supported in the bobbin case, and having a leaf spring with a first end attached thereto, the second end of which impinges upon the outer face of the bobbin flange. An indirect thread path is established by reeving the bobbin thread through a hook provided on the end of the leaf spring in engagement with the bobbin flange so that upon thread demand, the leaf spring is removed from the bobbin flange to permit free rotation thereof; but when thread demand ceases, the end of the leaf spring comes immediately into contact with the bobbin flange to deter further rotation thereof. An adjustment screw is provided which provides for variability of pressure contact of the second end with the bobbin flange for no interference with bobbin rotation upon thread demand or for only a small degree of interference therewith.

4 Claims, 6 Drawing Figures

Fig. 1
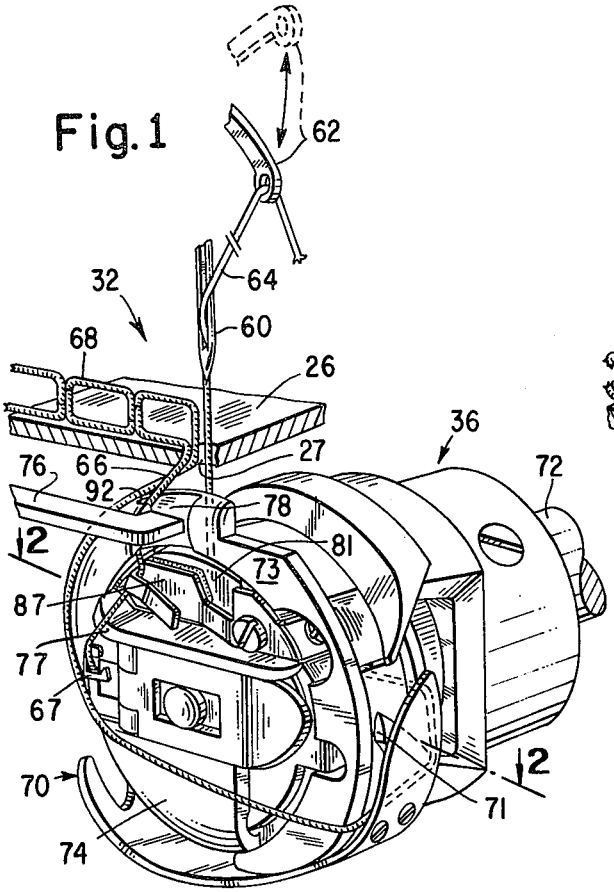
Fig. 3
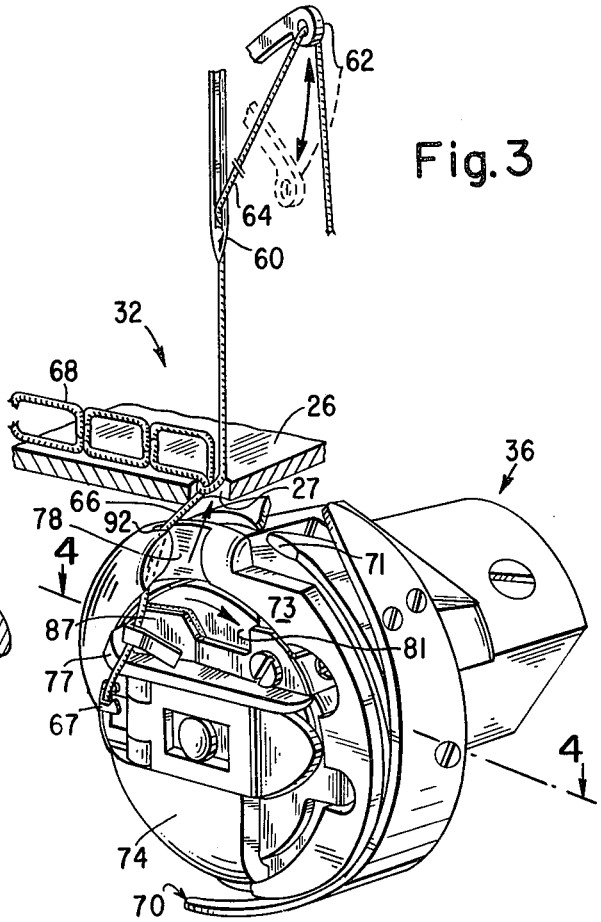
Fig. 2
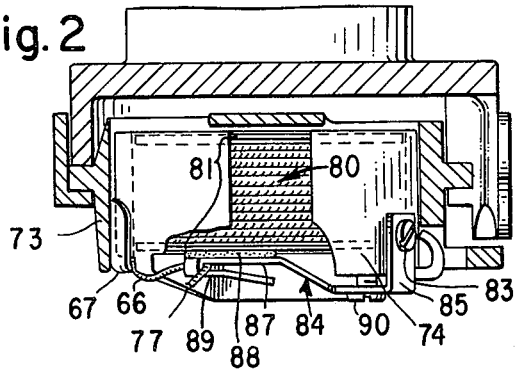
Fig. 4
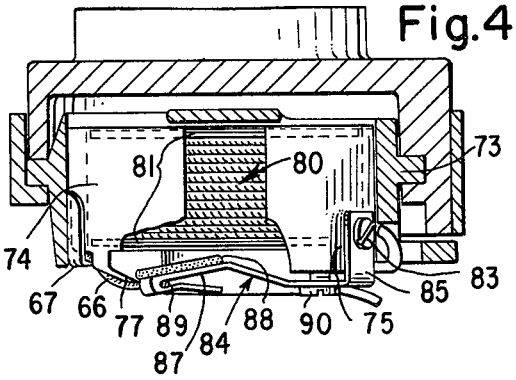
Fig. 6
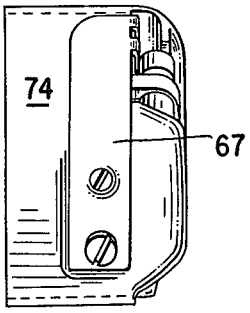
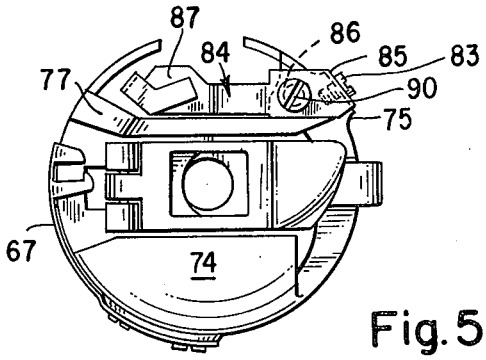
Fig. 5

ANTI-SPILL DEVICE FOR SEWING MACHINE BOBBIN

DESCRIPTION

BACKGROUND OF THE INVENTION

This invention is in the field of sewing machines; more particularly, it is concerned with an improved device for preventing rotation of the under thread bobbin of a lockstitch sewing machine except during times of thread demand in order to avoid spilling of the bobbin thread.

It frequently occurs that a freely spinning bobbin will release thread from the bobbin which will interfere with present or future stitch formation in the sewing machine. A freely spinning bobbin can result from a sudden machine stop from high speed operation, from a sudden pull on the bobbin thread from an under bed thread trimmer, or, simply, from a removal of work material from the sewing machine prior to cutting of needle and bobbin threads.

It is known in the prior art to apply to a bobbin containing lower thread, sufficient restraint to prevent overrunning of the bobbin and spilling of thread therefrom. Such a device is disclosed in U.S. Pat. No. 2,555,658, issued on June 5, 1951 to Ritter which utilized a leaf spring impinging on the bobbin flange to deter rotation thereof. Such a device is, however, effective at all times including times of thread demand, thereby having a sometimes adverse effect on bobbin thread tension.

It is also known to provide a pivoted lever in a bobbin case which is urged, for example, by a leaf spring into engagement with the periphery of a bobbin to restrain rotation thereof, but which lever is responsive to motion of bobbin thread caused by thread demand to pivot away from the bobbin flange periphery to allow free removal of thread therefrom. Such devices are disclosed in the U.S. Pat. Nos. 3,486,473, and 2,975,738, issued, respectively, on Dec. 30, 1969 and Mar. 21, 1961. However, these devices with their proliferation of fine parts including levers, pivot shafts, and spring loading means, are expensive and have been found to require very careful construction and adjustment.

What is required is a simple, inexpensive and fool proof device which may also be readily adapted for use in existing conventional arrangements.

SUMMARY OF THE INVENTION

The above object has been obtained in a device in which a leaf spring is fastened to a bobbin case in a position to extend over and against a bobbin flange and with a hook formed in the end thereof lying below the path of travel of bobbin thread from the bobbin thread tension to the work material. The end of the leaf spring is in contact with the bobbin flange, and thread demand occasioned by pulling up of the bobbin thread by the needle thread at the time of stitch setting, by feeding of work material, or by bobbin thread pull off device, will lift the ends of the leaf spring away from the bobbin flange to permit free rotation thereof during this period of thread demand. Immediately upon cessation of thread demand, the leaf spring returns into engagement with the bobbin flange and will thereby check continued rotation thereof.

DESCRIPTION OF THE DRAWINGS

With the above and additional objects and advantages in mind as will hereinafter appear, the invention will be described with reference to the attached drawings in which:

FIG. 1 is a fragmentary perspective of a looptaker, a needle and take-up at a time when the needle thread loop is being enlarged by the looptaker for casting about the sewing machine bobbin;

FIG. 2 is a section taken substantially along lines 2—2 of FIG. 1 to show the leaf spring of the invention in contact with the flange of the bobbin;

FIG. 3 is a view similar to FIG. 1 of a looptaker, needle and take-up after the needle loop has been cast about the bobbin and at the time of take-up of the needle thread initiating thread demand of the bobbin thread;

FIG. 4 is a view taken substantially along the line 4—4 of FIG. 3 to indicate the response of the leaf spring to the bobbin thread demand, deflected away from the bobbin flange to allow free rotation thereof;

FIG. 5 is a front elevation of the bobbin case indicating the attachment of the leaf spring thereto and the application of an adjusting screw thereon; and, FIG. 6 is a side elevation of the bobbin case shown in FIG. 5 showing the bobbin thread tension spring thereon.

In the usual sewing machine, well known in the prior art, there are provided the usual stitch forming instrumentalities including a sewing needle, and a looptaker, which sewing instrumentalities are driven by drive mechanisms equally as well known in the prior art. These drive mechanisms are situated in a sewing machine frame (not shown) which frame also supports therein well known mechanisms (not shown) for urging the sewing needle in endwise reciprocation and, in some cases, for influencing lateral motion of the sewing needle in the formation of zig zag stitches. The looptaker may be one of several known varieties, in this case, a horizontal axis rotating looptaker having been selected. However, by no means is the application of this invention limited to the use of this specific looptaker, since it will be obvious to those skilled in the art that this invention may be applied to any of those looptakers known in the art. With this caveat, the stitch forming instrumentalities 32 illustrated in FIGS. 1 and 3, includes the vertically reciprocated needle 60 and associated thread take-up member 62 which manipulates the needle thread in a conventional manner well known in the prior art, and cooperates with the looptaker 36 to concatenate the needle and bobbin thread 64 and 66, respectively, into a series of lockstitches, shown schematically and designated generally at 68. The needle reciprocates through an aperture 27 in a throat plate 26 supported above looptaker 36. The looptaker 36 includes a rotary hook 70 which is secured to a bed shaft 72 journalled in the sewing machine bed to rotate the hook 70 two revolutions for each vertical reciprocation of the needle 60 as is conventional in this type of sewing machine. Journalled within the rotary hook 70 is a bobbin case holder 73 within which is supported a bobbin case 74. The entire assembly is prevented from rotation by a rotation restraining finger 76 secured to the bed of the sewing machine and inserted into a rotation restraining notch 78 in the bobbin case holder 73. The rotary hook 70 includes a hook beak 71 which partakes of two revolutions in cooperation with each vertical reciprocation of the needle 60 to seize loops of thread from the needle and concatenate the seized thread loops about the bobbin case to form lockstitches. A bobbin 80 having flanges 81 carries the supply of bobbin thread 66 thereon and is disposed in the bobbin case 74 so that the axis of rotation of the bobbin 80 is coincident with the axis of rotation of the bed shaft 72. As is well known in the sewing machine art, the needle 60 is just past its low dead center position approximately at the time when the hook beak 71 is first engaging a loop of needle thread. As the hook beak 71 rotates, the needle loop is pulled thereby about the bobbin case 74 and thus about the bobbin 80 carried therein. The bobbin thread 66 extends from a bobbin thread tension spring 67 (see FIG. 6) to a boss 77 on the bobbin case 74 and to a slot 92 in the bobbin case holder 73. The boss and the portion of the slot wall closet to the looptaker form raised surfaces spaced from the flange 81. Thereafter the bobbin thread 66 extends upwardly to the last in the series of lockstitches 68.

Interposed between the end of the slot 92 in the bobbin case holder 73 and the boss 77 is a leaf spring 84. The leaf spring 84 is fashioned with an end piece 85 bent 90° to the body of the leaf spring, which end piece is fastened by a screw 83 to a boss 75 in the bobbin case 74 at the side thereof. Just inwardly of the end piece 85 the leaf spring 84 is formed with an aperture 86, which aperture is spaced from the bobbin case 74 and receives a screw 90 threadedly carried by the bobbin case 74 for adjustment purposes which will be described below. Beyond the aperture 86 the leaf spring 84 curves inwardly towards the flange 81 of bobbin 80, and the leaf spring is fashioned with a land 87, which land receives a braking pad 88 which rubs against the flange. The end of the leaf spring 84 is fashioned into a hook 89 for the purpose of receiving the bobbin thread extending inwardly thereto from the boss 77 and the slot 92 of the bobbin case holder 73 (see FIG. 1). The hook 89 lies below the level of the boss 77 and slot 92.

In FIG. 3 there is indicated the arrangement of the needle thread 64 to the bobbin thread 66 after the loop has been cast off by the hook beak 71 and the sewing machine thread take-up lever 62 has taken up the slack needle thread and begun to tug upon the bobbin thread to demand release of the bobbin thread from the bobbin 80. In FIG. 4 is shown a section taken across the looptaker 36 in FIG. 3 to show the arrangement of the leaf spring 84 at that moment when the bobbin thread 66 is being tugged up, for example, by the needle thread 64 under the action of the thread take-up lever 62. The leaf spring 84 may be deflected by the tension in the bobbin thread 66 due to the height of the boss 77 and slot 92 away from the bobbin 80 so that the braking pad 88 attached to the leaf spring is pulled away from the flange 81 of the bobbin. Thus, the bobbin 80 is free to rotate to release bobbin thread 66 to the series of lockstitches 68; however, as soon as thread demand ceases, the leaf spring 84 returns the braking pad 88 into engagement with the flange 81 of the bobbin in order to curtail rotation thereof and prevent overspinning which would cause spillage of bobbin thread. The material affixed to the land 87 of the leaf spring 84 may be selected to have a high coefficient of friction with the flange 81 of the bobbin 80 so as to provide a high retarding force to overspinning of the bobbin. The screw 90 may be turned inwardly to decrease the clearance between the leaf spring 84 at that point and the bobbin case 74, thereby increasing the pressure between the braking pad 88 and the flange 81 of the bobbin, or the pressure may be decreased to obtain the desired drag upon the bobbin or a complete removal of the braking pad from the flange upon thread demand. Adjustment to curtail spilling with a minimum effect on bobbin thread tension is readily attainable.

A more positive friction effect can be obtained by radially grooving the bobbin flanges 81 and providing a corresponding "V" notch in the land 87 of the leaf spring 84 which sequentially engages with the grooves. Alternatively, the bobbin flange 81 may be provided with small apertures at a given diameter which are engaged sequentially by a dimple on the land 87 of the leaf spring. Since the leaf spring 84 utilized to deter rotation of the bobbin 80 is separate from the bobbin thread tension spring 67 used to apply tension to the bobbin thread 66, it will be apparent to those skilled in the art, that this leaf spring arrangement may be applied to many prior art devices already in use which supply a bobbin thread tension spring but do not provide a means for deterring spilling of the bobbin thread.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

I claim:

1. A bobbin case device for a looptaker of a sewing machine, said sewing machine supporting an endwise reciprocating needle bar carrying a needle in the end thereof for cooperation with said looptaker in the formation of stitches, said bobbin case device comprising a bobbin case for receiving a thread carrying bobbin with at least one circular flange having a outer face; means support on said bobbin case for tensioning of bobbin thread; means on said bobbin case for establishing a direct bobbin thread patch extending substantially from said tensioning means across said bobbin case device spaced from said outer face of said circular flange of said thread carrying bobbin; said bobbin case further supporting thereon a leaf spring having a first end connected thereto and a second end disposed adjacent said bobbin thread path in pressure engagement with said outer face of said flange of said thread carrying bobbin; and means carried by said second end of said leaf spring for receiving said bobbin thread to form with said establishing means an indirect bobbin thread path responsive to bobbin thread demand for removing pressure from said pressure engagement of said second end with said outer face of said flange whereby bobbin rotation is uninhibited and responsive to absence of bobbin thread demand to release said second end into pressure engagement with said outer face of said flange to inhibit rotation of said bobbin.

2. A bobbin case device as claimed in claim 1 wherein said means for establishing a direct bobbin thread path includes raised surfaces on said bobbin case device spaced from said outer face and from each other with said leaf spring therebetween, and wherein said receiving means carried by said second end of said leaf spring is implemented by a hook formed by bending said second end of said leaf spring back upon itself.

3. A bobbin case device as claimed in claim 2 wherein said bobbin case device further comprises means carried by said bobbin case and associated with said leaf spring for varying the pressure engagement of said second end thereof with said oute face of said flange of said thread carrying bobbin.

4. A bobbin case device as claimed in claim 3 wherein said leaf spring includes a middle portion between said first and second ends spaced from said casing; and wherein said pressure varying means is implemented by an aperture in said leaf spring in said middle portion thereof, and an adjustment screw extending through said aperture into said bobbin case whereby said spacing of said middle portion from said casing may be varied to vary said pressure engagement of said second end of said leaf spring with said outer face of said bobbin flange.

* * * * *